US008636391B2

(12) United States Patent
Dellian et al.

(10) Patent No.: US 8,636,391 B2
(45) Date of Patent: Jan. 28, 2014

(54) LAMP AND END CAP FOR A LAMP

(75) Inventors: Harald Dellian, Edling (DE); Stefan Otzen, Munich (DE)

(73) Assignee: OSRAM AG, Munich (DE)

( * ) Notice: Subject to any disclaimer, the term of this patent is extended or adjusted under 35 U.S.C. 154(b) by 0 days.

(21) Appl. No.: 13/637,984

(22) PCT Filed: Apr. 8, 2011

(86) PCT No.: PCT/EP2011/055514

§ 371 (c)(1), (2), (4) Date: Sep. 28, 2012

(87) PCT Pub. No.: WO2011/124683

PCT Pub. Date: Oct. 13, 2011

(65) Prior Publication Data

US 2013/0021809 A1 Jan. 24, 2013

(30) Foreign Application Priority Data

Apr. 8, 2010 (DE) ..... 10 2010 003 717

(51) Int. Cl.
*F21S 13/02* (2006.01)

(52) U.S. Cl.
USPC ..... 362/457; 362/249.01; 362/217.01

(58) Field of Classification Search
USPC ..... 362/457, 217.01, 249.01
See application file for complete search history.

(56) References Cited

U.S. PATENT DOCUMENTS

| | | | | |
|---|---|---|---|---|
| 7,594,738 | B1 | 9/2009 | Lin et al. | |
| 2008/0094837 | A1 | 4/2008 | Dobbins et al. | |
| 2009/0091929 | A1* | 4/2009 | Faubion | 362/234 |
| 2011/0194278 | A1* | 8/2011 | Yang et al. | 362/217.12 |
| 2012/0099322 | A1* | 4/2012 | Simon et al. | 362/249.02 |
| 2012/0212953 | A1* | 8/2012 | Bloom et al. | 362/223 |

FOREIGN PATENT DOCUMENTS

| | | | |
|---|---|---|---|
| DE | 1954459 | U | 2/1967 |
| DE | 1954459 | A1 | 5/1971 |
| DE | 7914279 | U1 | 11/1979 |
| DE | 9111135 | U1 | 3/1992 |
| WO | 2009067074 | A1 | 5/2009 |

* cited by examiner

*Primary Examiner* — Evan Dzierzynski

(57) ABSTRACT

A rod-shaped retrofit lamp may have a mechanical sensing unit, and a current path has a plurality of electrically conductive sub-segments of which a first sub-segment is connected to the associated pin and of which a sub-segment is connected to the lamp's electronics unit, wherein the mechanical sensing unit is elastically pushed in counter to its projection direction from a released condition into an engaged condition and interacting with two current paths in such a way that the respective current path's first and second sub-segment will have been galvanically mutually coupled when the sensing unit is in the engaged condition so that the respective current path will have been closed and associated pin thereby electrically connected to the internal electronics unit.

13 Claims, 13 Drawing Sheets

LAMP AND END CAP FOR A LAMP

RELATED APPLICATIONS

The present application is a national stage entry according to 35 U.S.C. §371 of PCT application No.: PCT/EP2011/055514 filed on Apr. 8, 2011, which claims priority from German application No.: 10 2010 003 717.6 filed on Apr. 8, 2010.

TECHNICAL FIELD

The invention relates to a lamp, for example what is termed a retrofit lamp for fluorescent lamps, and to an end cap for a lamp.

BACKGROUND

Retrofit lamps having light-emitting diodes are known that can be fitted into existing luminaires as a replacement for the fluorescent lamps originally provided. For the known retrofit lamps it may, however, be necessary to modify the existing luminaire because said retrofit lamps cannot be operated on a specific existing conventional ballast for fluorescent lamps but are designed only for operation from an ac supply voltage. Known from US2008/0094837A1 is a retrofit lamp of such kind which, while being compatible with a conventional fluorescent lamp both mechanically and with regard to its holder, cannot be operated directly on a conventional ballast having a starter and not at all on an electronic operating device. For the retrofit lamp to be properly operated it is necessary to remove the original starter and bridge it with a jumper.

Retrofit lamps that can be fitted directly into existing systems as a replacement for fluorescent lamps are likewise known. An existing system of such kind for fluorescent lamps having a conventional ballast is shown in FIG. 1. The ac supply voltage $U_N$ is ducted via a choke D and applied to the fluorescent lamp at one side each of lamp electrode 1-2, 2-2. The other sides of lamp electrodes 1-1, 2-1 are connected to a starter S. For operation in systems of such kind it is necessary only to replace starter S with a jumper or fuse Si and to replace fluorescent lamp LL with retrofit lamp 5 as shown in FIG. 2. A direct connection of the two pins 2-1 and 2-2 is provided for shock-hazard protection reasons on a first end of the retrofit lamp so that the alternating voltage being applied to pin 2-2 will be looped through onto pin 1-1 via fuse Si. The operating device that operates the light-emitting diodes provided as light sources in the retrofit lamp is connected to pins 1-1 and 1-2 on the second end. Operating safety will be ensured when the retrofit lamp is being fitted because pins 2-1, 2-2 of the retrofit lamp's first end are galvanically isolated from pins 1-1, 1-2 of the retrofit lamp's second end so that someone putting one end of the lamp into its holder and touching one of the pins at the other end cannot receive an electric shock.

Known also as conventional ballasts especially in NAFTA countries are what are termed rapid-start circuits. FIG. 3 shows a conventional ballast 7 of such kind consisting substantially of a transformer with two windings each having a tap. The two windings are connected to each other at one end. The respective other winding end and the associated tap are connected to an electrode of fluorescent lamp LL. The ac supply voltage $U_N$ is applied to the connection between the two windings and to a tap. Were a retrofit lamp to be designed for a circuit of such kind, then the retrofit lamp's internal electronics unit would need to evenly load the two electrodes or pins on the ends because conventional ballast 7 would otherwise be subjected to an asymmetric load. A known circuit for a retrofit lamp is shown in FIG. 4. One 'electrode' of the retrofit lamp is connected to a full-wave rectifier GL1 and the other to full-wave rectifier GL2. The two rectifiers are connected in parallel on the direct-voltage side and connected to the direct-voltage side is an operating device 22 that operates light-emitting diodes 55. Because the direct-voltage outputs of the two full-wave rectifiers GL1 and GL2 are connected in parallel there is a galvanic coupling between the retrofit lamp's two ends. Someone wishing to fit a lamp of such kind into its holder will be at risk because if only one end of the retrofit lamp is inserted (fitting the lamp at an angle), the other end can conduct in certain fault situations and can also be touched. While normally an operator who touches the retrofit lamp's contacts will be protected by the full-wave rectifiers' blocking diodes, a fault may cause one of the diodes to fail, for example, so that a current can flow from one side to the other and through the person who is touching. That poses a substantial hazard for the operator, which is why circuits of such kind are generally not allowed. The retrofit lamps shown in FIG. 2 exhibiting galvanic separation cannot be used owing to the asymmetric loading of the conventional ballast in the rapid-start circuit.

SUMMARY

Various embodiments disclose a lamp and an end cap for a lamp that both make enhanced operating safety possible.

Various embodiments disclose a lamp (a retrofit lamp, for instance) that can be operated adequately safely on luminaires having a rapid-start circuit or on other luminaires that are supplied with energy at both ends in order thereby, for example, to obviate modifying the luminaire, which would in any event not be permissible.

The inventive lamp and inventive end cap enable the two lamp ends to be galvanically isolated during the fitting process and said ends to be galvanically coupled while the lamp is operating or, as the case may be, when the lamp has been properly fitted. For that purpose the respective current path between the pins and the lamp's electronics unit is interrupted on at least one lamp-end side when the lamp is in the dismantled condition, as a result of which the galvanic decoupling of the two lamp ends is achieved. The respective current path is closed by pushing in a mechanical sensing unit which interacts with the current paths or, as the case may be, their electrically conductive sub-segments.

The mechanical sensing unit is arranged on one of the lamp's two end faces and projects therefrom. It is thereby possible to sense the lamp's fitting condition while the lamp is being fitted by its end face into the holder. That means to say the mechanical sensing unit can be embodied such as to detect that the lamp has been properly fitted and thereupon to close the current path. A suitable embodiment of the sensing unit will enable, for example, a parallel disposition of the lamp's end face to the holder's end face to be detected/sensed. That can be done by way of, for example, a plurality of sensing elements distributed over the end face. For example the lamp has an elongated form with an end face on each of its two longitudinal ends. The two pins and the sensing unit will then project for example substantially in the axial direction from one of the end faces, meaning in the lamp's longitudinal direction. The lamp's end face can be formed, for example, from an end cap's end face. The respective current path can be accommodated in the end cap, for instance.

The sensing unit inventively interacts with the two current paths in such a way that the respective current path's first sub-segment connected to the pin will have been galvanically decoupled from the respective current path's second sub-segment connected to the lamp's electronics unit when the sensing unit is in the released condition so that the respective current path will be interrupted and the associated pin therefore galvanically decoupled from the lamp's electronics unit. That means that both pins will have been galvanically decoupled from the lamp's electronics unit when the sensing unit is in the released condition. In other words, neither of the two pins will be electrically connected to the lamp's electronics unit or, as the case may be, to the other end of the lamp when the sensing unit is in the released condition.

A flow of current between the two ends of the lamp when it is fitted at an angle can hence be reliably avoided if it is first fitted into the holder by the operator by its end having the sensing unit, because the current path will not be closed by the sensing unit until proper fitting has been detected. The lamp consequently exhibits enhanced operating safety.

Both lamp ends are according to an embodiment variant of the invention furnished with a mechanical sensing unit to ensure that when the lamp is fitted at an angle its longitudinal end fitted first into the holder has a sensing unit and for the eventuality of the operator's gripping the longitudinal end furnished with the sensing unit in such a way that the sensing unit is in the engaged condition while the other longitudinal end is located in the holder. A flow of current between the two ends of the lamp or, as the case may be, between a pin of one longitudinal side and a pin of the other longitudinal side while the lamp is being fitted at an angle can in that way be virtually totally precluded and operating safety further enhanced.

According to another embodiment variant of the invention, the at least one sensing unit is located partially or completely in the circumferential region of the lamp's end face. If the sensing unit has a plurality of sensing segments, then the sensing segments will each be located, for example, partially or completely in the circumferential region of the lamp's end face. Positioning of the lamp's front face parallel to the holder's front face can be effectively detected thereby or, as the case may be, distinguished from angular positioning.

According to another embodiment variant of the invention, in its engaged condition the at least one sensing unit pushes against an elastically bendable electrically conductive sub-segment of the current path. If the sensing unit has a plurality of sensing segments, then, for example, each sensing segment will in the engaged condition push against an elastically bendable electrically conductive sub-segment. Tolerances between the luminaire's holder and the lamp can be compensated thereby. That means that the sensing unit or, as the case may be, sensing segments will initially push the elastically bendable current-path sub-segment(s) down far enough to close the current path and can then push the elastically bendable current-path sub-segment(s) down further, with that "surplus" sensor path being compensated by way of the elasticity or, as the case may be, bending of the elastically bendable current-path sub-segment. To limit the surplus sensor path the sensing unit (or, as the case may be, each sensing segment) may have, for example, a stop by means of which the sensing unit's maximum engagement depth will be limited.

According to another embodiment variant of the invention the at least one sensing unit has a plurality of sensing segments embodied as capable of being pushed in elastically. The sensing segments can be formed by, for example, separate sensing elements. A plurality or all of the sensing segments can, though alternatively also be formed from a single-piece sensing element, for example an annular sensing element. The sensing segments interact with the two current paths in such a way that the respective current path's first and second sub-segment will not be galvanically mutually coupled unless all the sensing segments are simultaneously in the engaged condition, whereas the respective current path's first sub-segment will have been galvanically decoupled from the respective current path's second sub-segment as soon as at least one of the sensing segments is in the released condition. That means that both pins will have been decoupled from the lamp's electronics unit if at least one of the sensing segments is in the released condition. Suitably positioning the sensing segments on the lamp's front face will enable the position of the lamp's front face relative to the holder's front face (parallel or angular positioning) to be effectively sensed. For example the at least one sensing unit can have three or more sensing segments that are distributed among three 120° front-face sectors. For example the at least one sensing unit can have four or more sensing segments that are distributed among four 90° front-face sectors. Such kind of distribution of the sensing segments will enable fitting of the lamp at an angle or, as the case may be, angular positioning of the lamp's end face to be reliably distinguished from proper fitting of the lamp or, as the case may be, parallel positioning of the lamp's end face with a smaller number of sensing segments. The sensing segments can for example be distributed substantially evenly in the front-face circumferential direction.

For example the respective current path can be formed from a plurality of electrically conductive sub-segments arranged one behind the other, with mutually adjacent sub-segments overlapping in a spaced-apart manner when the sensing segments are in the released condition so that the current path will be interrupted at the overlap segments. The sub-segments in the overlapping regions will have been brought into electric contact by the pushed-down sensing segments when the sensing segments are in the engaged condition. The sub-segments will hence have been connected in series when the sensing segments are in the engaged position, with, for example, the first and last sub-segment (meaning the two outer sub-segments) being electrically connected to the pin or, as the case may be, the lamp's electronics unit. For example the respective current path can have been interrupted more than once. Each interruption can therein have been assigned, for example, precisely one sensing segment. The respective current path's electrically conductive sub-segments can be arranged, for example, one behind the other viewed in the circumferential direction of the end face or, as the case may be, in the circumferential direction of the lamp. Mutually adjacent sub-segments can overlap spaced for instance axially apart, meaning spaced apart in the lamp's longitudinal direction, when the sensing segments are in the released condition.

For example the respective current path's electrically conductive sub-segments can be embodied as strips. For example a plurality of pairs of strips each consisting of a top strip (for example an axially top strip) and a bottom strip (for example an axially bottom strip) can be arranged one behind the other (for example behind each other in the circumferential direction), with the top strips forming an (axially) top current path and with the bottom strips forming an (axially) bottom current path. The strips can each extend, for example, substantially in the radial direction.

The respective current path can alternatively, for example, have a plurality of electrically conductive ring arcs arranged one behind the other.

According to an embodiment variant, the respective current path's electrically conductive sub-segments are embodied as overlapping ring arcs (for example as circle arcs). Mutually adjacent ring arcs can therein each be bent upward in the overlapping region, for example. That means that in the respective overlapping region an upwardly bent end segment of one ring arc is overlapped/encroached on in a spaced-apart manner by an upwardly bent end segment of the other ring arc. The further upwardly bent end segment can, for example, serve as a restoring spring for a sensing segment. The other end segment will enable the sensing segment to be pushed in further after contacting of the two end segments in order to compensate tolerances between the holder and lamp. For example a radially inner current path and a radially outer current path can be provided. The respective current path can be shaped, for example, like a slit ring.

According to another embodiment variant, together with electrically conductive sub-segments attached to the sensing segments, a plurality of electrically conductive sub-segments, for example ring arcs, arranged spaced apart one behind the other form a current path (for example a current path having multiple interruptions). When the sensing segments are in the engaged condition the sub-segments arranged spaced apart one behind the other are electrically connected in series via the sub-segments attached to the sensors. The current-path sub-segments attached to the sensing segments can, for example, be elastically bendable in the axial direction to enable tolerances to be compensated. For example a radially inner current path and a radially outer current path can be provided. The respective current path can be shaped, for example, like a slit ring.

According to an embodiment variant the galvanic coupling of the respective current path's first and second sub-segment is achieved directly through the sensing unit's or, as the case may be, all the sensing segments' being pushed in.

According to an alternative embodiment variant of the invention the galvanic coupling is achieved through the sensing unit's first being pushed downward and then in the pushed condition being rotated relative to the electrically conductive sub-segments. If the sensing unit has a plurality of sensing segments then each sensing segment will be able to block the relative rotational movement in its released condition and enable it in its engaged condition. That means that the sensing segments all have to be pushed down first to be able in the pushed-down condition to galvanically couple the respective current path's first and second sub-segment by means of the relative rotational movement.

The inventive end cap can, for example, be attached to a longitudinal end of a tube having one or more LEDs. The end cap's end face will then form the lamp's end face.

Further developments and embodiments of the inventive lamp and end cap will emerge from the following description.

BRIEF DESCRIPTION OF THE DRAWINGS

Further aspects, features, and specifics of the invention will emerge from the following description of exemplary embodiments and with the aid of the figures in which identical or functionally identical elements have been assigned the same reference numerals/letters.

DETAILED DESCRIPTION

The following detailed description refers to the accompanying drawings that show, by way of illustration, specific details and embodiments in which the invention may be practiced.

Figure 1:
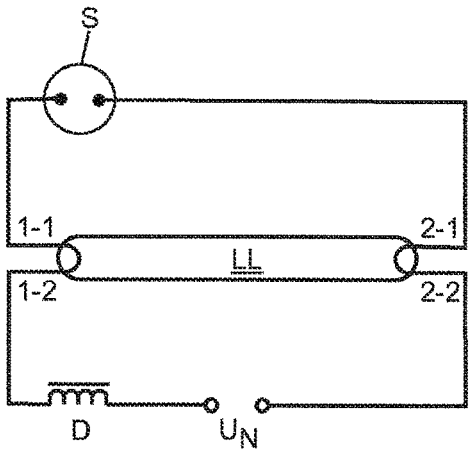
FIG 1 (Prior art)
FIG. 1 shows an existing system for fluorescent lamps having a conventional ballast.
Figure 2:
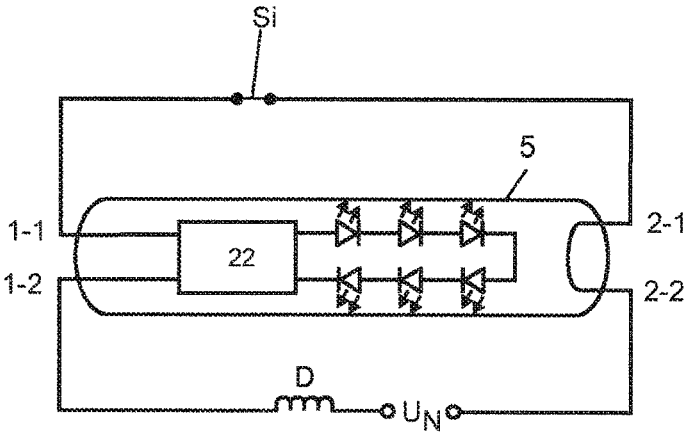
FIG 2 (Prior art)
FIG. 2 shows the system shown in FIG. 1, with starter S having been replaced by a fuse Si and fluorescent lamp LL having been replaced by a retrofit lamp 5.
Figure 3:
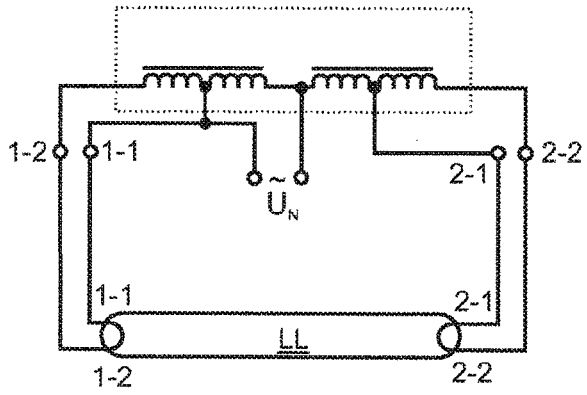
FIG 3 (Prior art)
FIG. 3 shows another existing system for fluorescent lamps having a conventional ballast 7 that has what is termed a rapid-start circuit.
Figure 4:
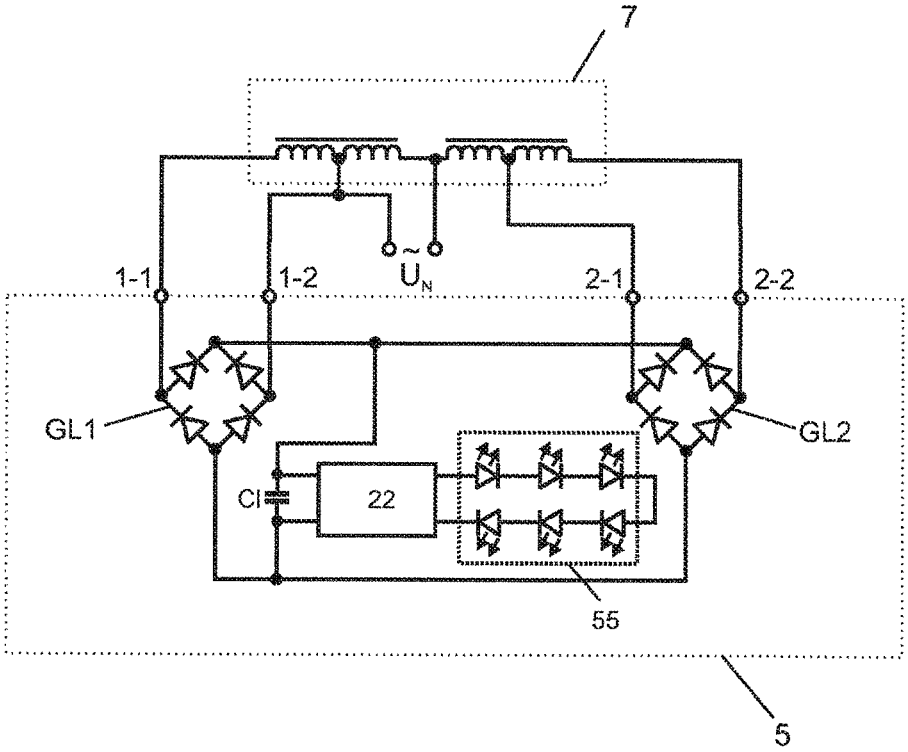
FIG 4 (Prior art)
FIG. 4 shows a known circuit for a retrofit lamp 5.

End caps 1 according to different embodiment variants of the invention are described below. A first inventive end cap 1 can, for example, be put onto one of the two longitudinal ends of a tube (not shown) belonging to a lamp (for example what is termed a retrofit lamp). A second inventive end cap 1 can, for example, be put onto the tube's other longitudinal end. Different inventive end caps 1, which is to say end caps belonging to different embodiment variants, or end caps 1 belonging to the same embodiment variant can be used if both the tube's longitudinal ends have been furnished with an inventive end cap 1. A plurality of LEDs, for example, can be located inside the tube. For example the lamp can be constructed like retrofit lamp 5 described in the introduction and shown schematically in FIG. 4, which is to say it can have four pins 1-1, 1-2, 2-1, 2-2 (with the two pins 1-1 and 1-2 being attached to one longitudinal end of the lamp and the two pins 2-1 and 2-2 being attached to the lamp's other longitudinal end) and the lamp's internal electronics unit (full-wave rectifiers GL1 and GL2, operating device 22, light-emitting diodes 55 etc.) shown in FIG. 4. A retrofit lamp furnished with one or two inventive end caps can be fitted into a luminaire having what is termed a rapid-start circuit, as shown in FIG. 4.

Figure 5:
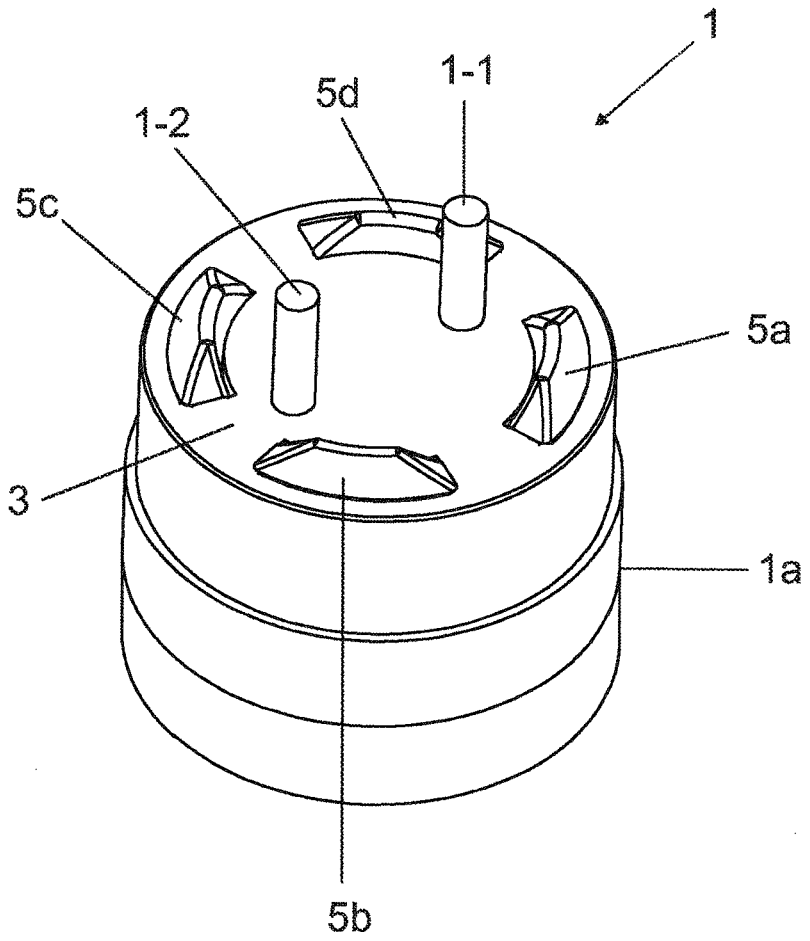
FIG. 5 shows an end cap 1 according to an embodiment variant of the invention.

FIGS. 5, 6, and 7*a*-7*d* show an end cap 1 according to a first embodiment variant of the invention. End cap 1 can alternatively be referred to also as a base. End cap 1 has a substantially cylindrical housing section 1*a* with a circular end face/front face 3 from which two pins 1-1, 1-2 project axially. Housing section 1*a* can be made of, for example, plastic. The pins can alternatively be referred to as contact pins. Also projecting axially from front face 3 are four sensing elements 5*a*-5*d* that together form a sensing unit and which can be made of, for example, plastic. A correspondingly shaped opening is formed in front face 3 for each sensing element 5*a*-5*d*. Pins 1-1, 1-2 project further than sensing elements 5*a*-5*d*. Sensing elements 5*a*-5*d* all project equally. If the front face is divided into four 90° sectors (as indicated in FIG. 5 by the two dashed lines), then there will be a sensing element in each 90° sector. For example each sensing element is located centrally in its sector in the circumferential direction. If front face 3 is further divided into a central region and a circumferential region surrounding the central region (as indicated in FIG. 5 by the dashed circle), then sensing elements 5*a*-5*d* are each located in the circumferential region (=outer edge region) of front face 3. For example the circumferential region's inside diameter can be greater than the distance between the two pins 1-1 and 1-2.

The four sensing elements 5*a*-5*d* can each be pushed in axially (meaning in the lamp's longitudinal direction) downward, meaning toward front face 3. The four sensing elements 5*a*-5*d* must all be actuated simultaneously to bring the two pins 1-1 and 1-2 into electric contact with the lamp's internal electronics unit, for example full-wave rectifier GL1 shown in FIG. 4. That means that neither first pin 1-1 nor second pin 1-2 will make electric contact with full-wave rectifier GL1 unless all four sensing elements 5*a*-5*d* have been pushed down simultaneously. If, though, only three or fewer sensing elements have been pushed down simultaneously, neither first pin 1-1 nor second pin 1-2 will be in electric contact with full-wave rectifier GL1.

If a lamp one of whose longitudinal ends has been furnished with end cap 1 has been properly fitted into a luminaire by both its longitudinal ends, then front face 3 of end cap 1 will be substantially parallel to the front face of the luminaire's holder. Sensing elements 5*a*-5*d* therein each lie substantially flat against the holder's front face and are each pushed down through contact with the holder so that both pins 1-1, 1-2 make electric contact with full-wave rectifier GL1 or, as the case may be, are galvanically coupled thereto.

However, for as long as the lamp is fitted into the holder by only one longitudinal end, with the other longitudinal end being held in the operator's hand (=the lamp is being fitted slantwise/obliquely), the lamp's two front faces 3 will be at an angle to the holder's front face. If the lamp is therein fitted into its holder first by its longitudinal end having end cap 1, then owing to the above angular position at least one of sensing elements 5*a*-5*d* will not at all lie against the holder's front face or will not have been pushed down far enough so that the two pins 1-1, 1-2 will each be galvanically decoupled from full-wave rectifier GL1. So even if the operator, having fitted the lamp at an angle, touches one or both of opposite pins 2-1, 2-2 and pins 2-1, 2-2 have been galvanically coupled to associated full-wave rectifier GL2, there will be no flow of current between a pin 1-1, 1-2 of one longitudinal side and a pin 2-1, 2-2 of the other longitudinal side.

Thus a flow of current between the lamp's two longitudinal ends when it has been fitted at an angle can be reliably avoided if the lamp is fitted by the operator into its holder first by its end having inventive end cap 1.

If, conversely, the lamp is fitted into its holder first by its (unprotected) longitudinal end opposite end cap 1, then to receive an electric shock the operator would have to simultaneously push down all four sensors 5*a*-5*d* on the free longitudinal end far enough and in doing so contact one of the pins.

In order, though, also to preclude that eventuality, both longitudinal ends are furnished with an inventive end cap according to an embodiment variant of the invention so that it will have been ensured that a longitudinal end bearing an inventive end cap will always have been fitted into the lamp's holder if the lamp is fitted at an angle.

Figure 6:
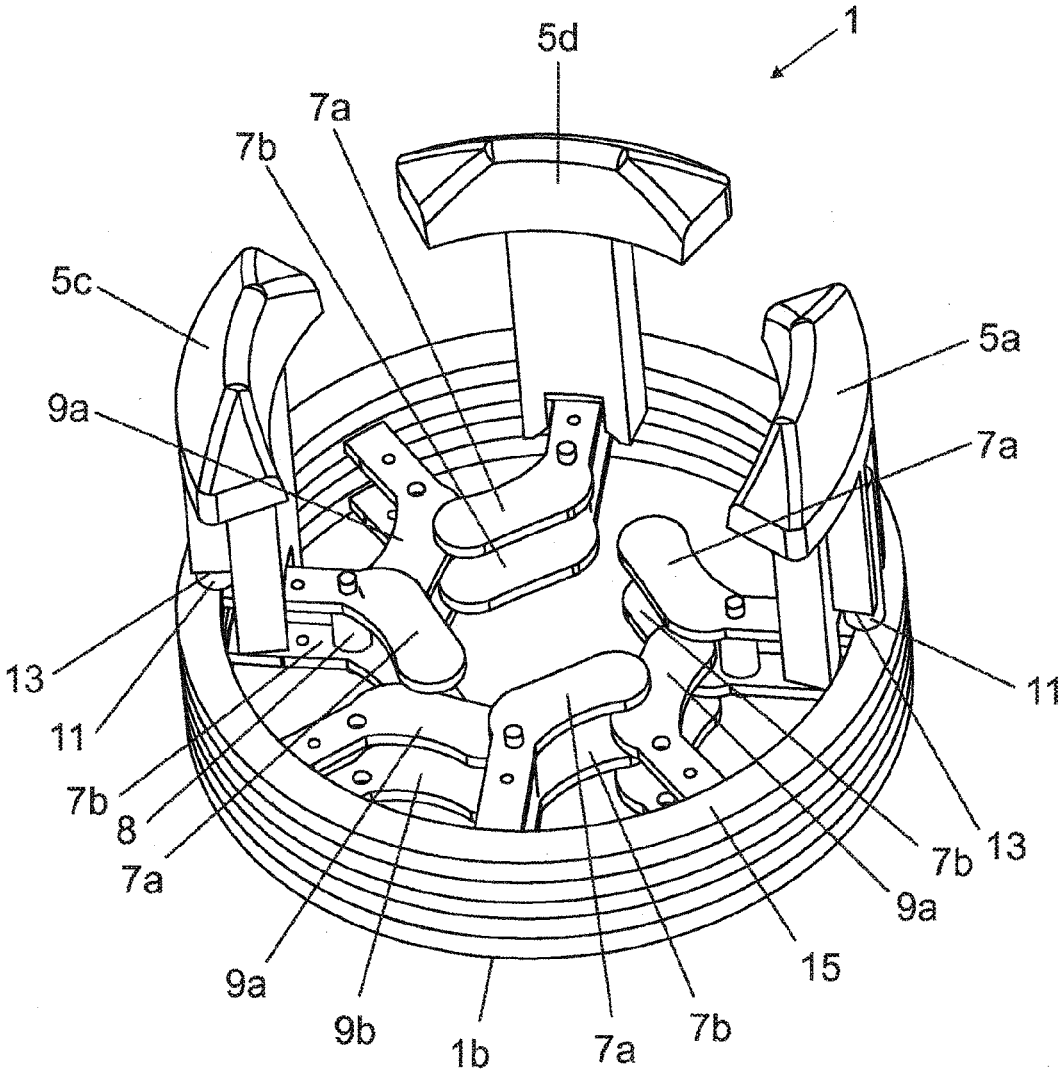
FIG. 6 shows the end cap 1 shown in FIG. 5, with the end cap's housing section 1*a* omitted, FIGS. 7*a*+7*b* show the sensing elements of end cap 1 shown in FIG. 5 in the released condition, FIGS. 7*c*+7*d* show the sensing elements of end cap 1 shown in FIG. 5 in the engaged condition.

The interaction of sensing elements 5*a*-5*d* with the two pins' current paths is described below with reference to FIG. 6. In the interests of clarity, the two pins and sensing element 5*b* are not shown. Housing section 1*a* of end cap 1 has furthermore been omitted.

A ring segment 1*b* of end cap 1 has a plurality of electrically conductive strips 7*a*, 7*b*, 9*a*, 9*b* that each extend in the radial direction and form electrically conductive sub-segments of the current paths for the two pins. That means each strip constitutes, for example, a sub-segment of such kind. The strips can be embodied as, for instance, sheet-metal strips (the strips are referred to below as sheet-metal strips; however, the strips do not have to be made of metal but can be made of another suitable, electrically conductive material). Sheet-metal strips 7*a*, 7*b*, 9*a*, 9*b* are each permanently attached by their radially outer end to the ring segment, being for example embedded therein, and project from the ring segment's inner lateral surface at their radially inner, free end into the ring segment's free interior. Sheet-metal strips 7*a*, 7*b*, 9*a*, 9*b* are arranged in pairs, with seven pairs of sheet-metal strips being provided one behind the other in the circumferential direction.

Each of the four sensing elements 5*a*-5*d* is assigned a pair of sheet-metal strips that include a top sheet-metal strip 7*a* and bottom sheet-metal strip 7*b* and are linked to each other via a spacer 8. Said four pairs of sheet-metal strips 7*a*, 7*b* are distributed evenly in the circumferential direction correspondingly to the four sensing elements 5*a*-5*d*. The four pairs of sheet-metal strips 7*a*, 7*b* are all mounted at the same height. When top sheet-metal strip 7*a* of a pair of sheet-metal strips is pushed down, then bottom sheet-metal strip 7*b* of the pair of sheet-metal strips will likewise be pushed/bent down via spacer 8. Top sheet-metal strip 7*a* can for that purpose be pushed down near its fixed end by the assigned sensing element's bottom end. Embodied on each sensing element's radially outer side is a downwardly open accommodating space in which a restoring spring 11 is accommodated. Restoring spring 11 is supported at one end against top edge area 15 of ring segment 1*b*. In the non-loaded condition (=lamp removed), the respective sensing element can either have been pushed into its released position (pretensioned spring) by the spring force of spring 11 or be positioned against assigned top strip 7*a*. In the loaded condition (=lamp fitted), the respective sensing element has been elastically pushed in counter to its projection direction, which is to say axially downward in the longitudinal direction, against the spring force from its released condition into an engaged condition. The respective sensing element's downward motion is limited by a stop 13 formed by the bottom end of the accommodating space.

Located between the four pairs of sheet-metal strips 7*a*, 7*b* assigned to the sensing elements are three pairs of connecting sheet-metal strips 9*a*, 9*b* each consisting of a top connecting sheet-metal strip 9*a* and a bottom connecting sheet-metal strip 9*b*. The three pairs of connecting sheet-metal strips 9*a*, 9*b* are distributed over three of the four spaces formed between the four pairs of sheet-metal strips 7*a*, 7*b*. The three pairs of connecting sheet-metal strips 9*a*, 9*b* are all mounted at the same height and each offset axially downward with respect to the four pairs of sheet-metal strips 7*a*, 7*b* or, as the case may be, are set lower, for example by a few millimeters, with the sheet-metal strips belonging to pairs of adjacent sheet-metal strips mutually overlapping.

If the pair of sheet-metal strips 7*a*, 7*b* assigned to sensing element 5*d* has been bent downward as a result of sensing element 5*d* having been pushed down, then top sheet-metal strip 7*a* will be axially in electric contact with top connecting sheet-metal strip 9*a* of the bordering pair of connecting sheet-metal strips and bottom sheet-metal strip 7*b* will be axially in electric contact with bottom connecting sheet-metal strip 9*b* of the bordering pair of connecting sheet-metal strips. If sensing element 5*d* has not been pushed or, as the case may be, not been pushed forcefully enough, then top sheet-metal strips 7*a*, 9*a* and bottom sheet-metal strips 7*b*, 9*b* will in each case be galvanically mutually separated. If adjacent sensing element 5*c* has been pushed down far enough, then associated top sheet-metal strip 7*a* will be axially in electric contact with the two bordering top connecting sheet-metal strips 9*a* and associated bottom sheet-metal strip 7*b* will be axially in electric contact with the two bordering bottom connecting sheet-metal strips 9*b*. Sheet-metal strips 7*a*, 7*b* assigned to sensing element 5*c* are in the non-pushed condition not in electric contact with any of bordering connecting sheet-metal strips 9*a*, 9*b*. A similar situation applies to the two sensing elements 5*b*, 5*a* and associated sheet-metal strips 7*a*, 7*b*. When sensing elements 5*a*-5*d* have all been pushed simultaneously, then top sheet-metal strip 7*a* assigned to sensing element 5*d* will be in electric contact with top sheet-metal strip 7*a* of sensing element 5*a* and bottom sheet-metal strip 7*b* assigned to sensing element 5*d* will be in electric contact with bottom sheet-metal strip 7*b* of sensing element 5*a*. That means that top sheet-metal strips 7*a*, 9*a* and bottom sheet-metal strips 7*b*, 9*b* will in each case be connected in series when the sensing elements have all been pushed simultaneously.

Top sheet-metal strips 7*a*, 9*a* are assigned to one pin's current path and bottom sheet-metal strips 7*b*, 9*b* are assigned to the other pin's current path. That means the top sheet-metal strips form a current path from one pin to the lamp's electronics unit, which path is interrupted at several places, and the bottom sheet-metal strips form a current path from the other pin to the lamp's electronics unit, which path is interrupted at several places. For example top sheet-metal strip 7*a* assigned to sensing element 5*d* can be wired to one pin, bottom sheet-metal strip 7*b* of sensing element 5*d* can be wired to the other pin, top sheet-metal strip 7*a* of sensing element 5*a* can be wired to the terminal segment—provided for one pin—of the lamp's electronics unit (full-wave rectifier GL1), and bottom sheet-metal strip 7*b* of sensing element 5*a* can be wired to the terminal segment of the lamp's electronics unit for the other pin. When the sensing elements have all been pushed simultaneously so that top sheet-metal strips 7*a*, 9*a* and bottom sheet-metal strips 7*b*, 9*b* are in each case connected in series, then the respective current path will have been closed and the associated pin thereby electrically connected to the internal electronics unit. If, though, at least one of the sensing elements has not been pushed down far enough, then the two current paths on the pair of sheet-metal strips (current-path sub-segment) assigned to that sensing element will have been interrupted and the two pins consequently galvanically decoupled from the lamp's electronics unit.

Figure 7A:
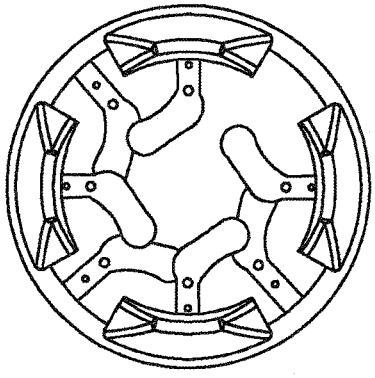
Figure 7B:
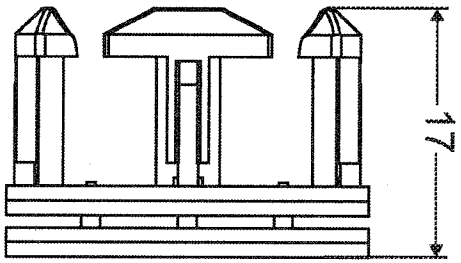
Figure 7C:
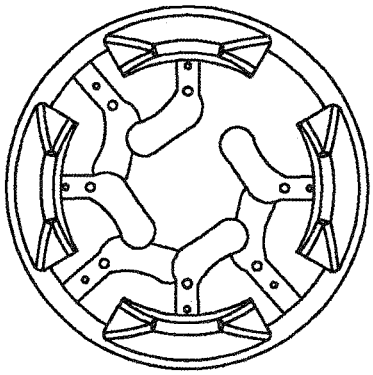
Figure 7D:
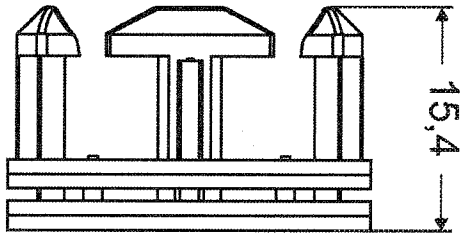

The sensing elements/sensors are shown in the non-pushed condition in FIGS. 7*a* and 7*b* whereas FIGS. 7*c* and 7*d* show the sensing elements/sensors in the pushed condition.

The maximum sensor travel or, as the case may be, maximum push-in depth, which is to say the extent to which sensing elements 5*a*-5*d* can be pushed down counter to their projection direction, is limited by stop area 13 (for example the maximum sensor travel is 2-4 mm, for example 3 mm). Sheet-metal strips 7*a*, 7*b* assigned to sensing elements 5*a*-5*d* can thereby be prevented from being "pushed through" until they are below connecting sheet-metal strips 9*a*, 9*b* or the sheet-metal strips can thereby be prevented from being displaced from end cap 1 or, as the case may be, ring segment 1*b*, for example from a plastic embedment located there, owing to excessive bending.

Sensing elements 5*a*-5*d* and sheet-metal strips are moreover designed such that sensing elements 5*a*-5*d* will bend respective top sheet-metal strips 7*a* sufficiently far down for contacting sheet-metal strips 7*a*, 7*b* with sheet-metal strips 9*a*, 9*b* significantly before the maximum sensor travel is reached/achieved (for example sensing elements 5*a*-5*d* can already close the contact between associated sheet-metal strips 7*a*, 7*b* and bordering connecting sheet-metal strips 9*a*, 9*b* after a sensor travel of approximately 1 mm). With contact still being maintained, the respective sensing element can be pushed down further after sheet-metal strips 9*a*, 9*b* have been contacted by sheet-metal strips 7*a*, 7*b*, with the "surplus" sensor travel being compensated by way of the sheet-metal strips' elasticity or, as the case may be, bending thereof. Contacting of sheet-metal strips 9*a*, 9*b* by sheet-metal strips 7*a*, 7*b* can in other words take place in a sensor-travel window/interval. Tolerances between the luminaire's holder and the lamp can be compensated thereby.

According to an alternative embodiment variant, the sheet-metal strips assigned to sensing elements 5*a*-5*d* can be attached to the underside of sensing elements 5*a*-5*d* so that they can be moved downward with sensing elements 5*a*-5*d* in the lamp's longitudinal direction axially against the spring force of spring 11 in order to contact sheet-metal strips 9*a*, 9*b* secured to the ring segment and thereby close the current path.

Figure 8A:
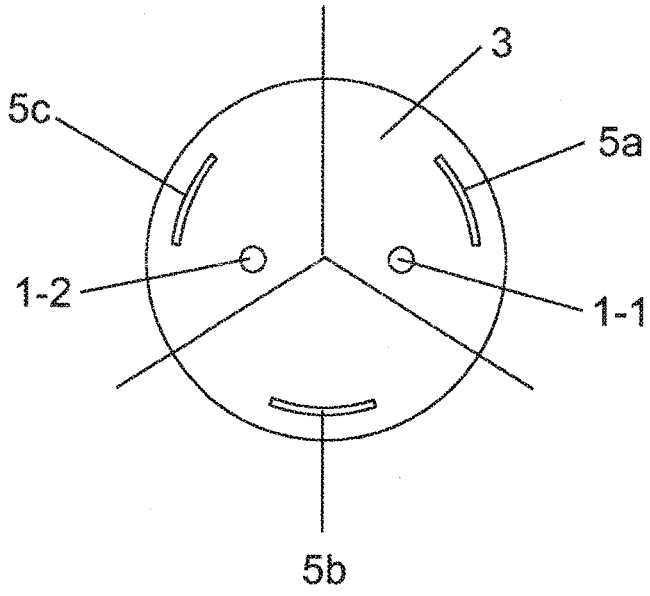
FIGS. 8*a*-8*d* are a top view of the end caps according to other embodiment variants of the invention.
Figure 8B:
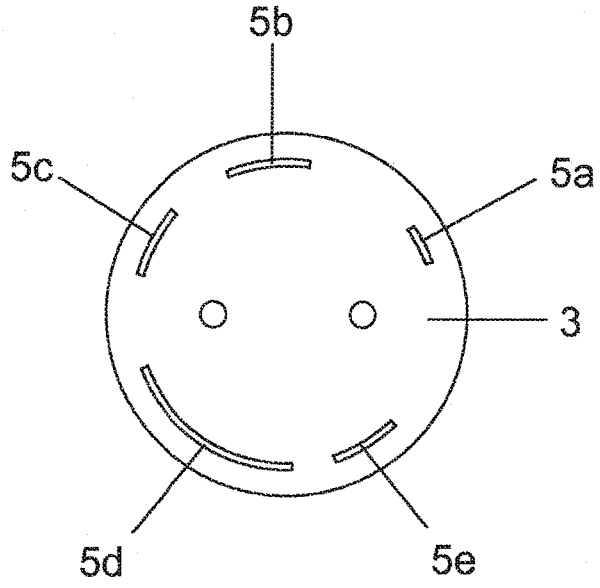
Figure 8C:
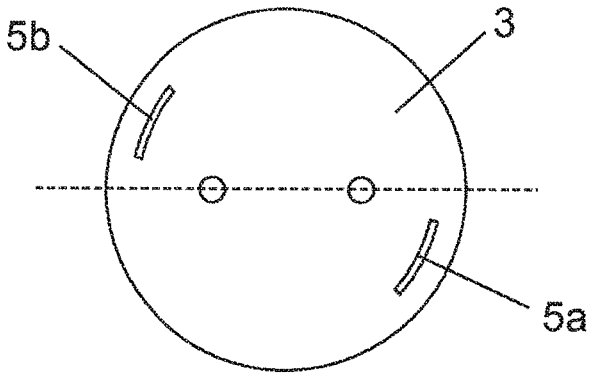
Figure 8D:
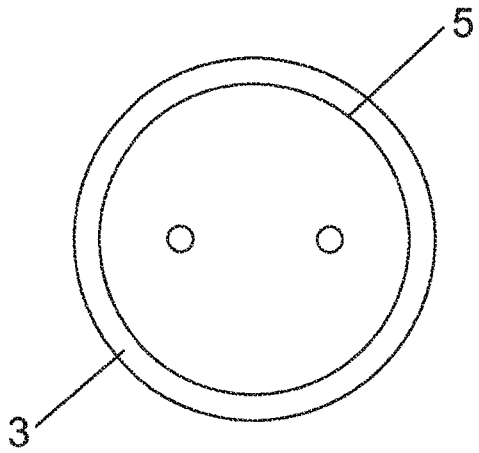

As shown schematically in FIGS. 8*a* to 8*d*, the number of sensing elements can be varied. As shown in FIG. 8*a*, for example precisely three sensing elements 5*a*-5*c* can have been provided that are distributed evenly in the circumferential direction and are located one each in three 120° sectors. With an arrangement of such kind it will be possible with just three sensing elements to reliably detect numerous oblique positions of the end face relative to the holder and hence the lamp's being fitted at an angle. Sensing elements 5*a*-5*c* can, though, also be augmented by further sensing elements. As can be seen from FIG. 8*b*, the sensing elements do not have to be distributed evenly in the circumferential direction and can, moreover, have different dimensions. FIG. 8*c* shows an embodiment variant in which only two sensing segments 5*a* and 5*b* are provided. The two sensing segments 5*a* and 5*b* are located adjacently to the two longitudinal ends of the front-face diameter extending through the two pins 1-1 and 1-2. The two pins 1-1, 1-2 are as a rule pushed into a vertical slot in the holder when the lamp is being fitted. Most oblique positions therein occurring when the lamp is fitted on one side can already be detected by means of sensing segments 5*a* and 5*b* (or an arrangement consisting of sensing elements 5*c* and 5*d* shown in FIG. 5). The two sensing segments shown in FIG. 8*c* can, though, also be augmented by further sensing elements in order to enhance operating, for example as shown in FIG. 5. FIG. 8*d* shows an embodiment variant having a single circular sensing element 5. A sensing element of such kind can, for example, be used in place of the four sensing elements 5*a*-5*d* in the arrangement shown in FIG. 6. Sensing element 5 has a plurality of sensing segments that can be pushed down analogously to sensing elements 5*a*-5*d* in order thereby to bend/push down top sheet-metal strips 7*a*. A sensing element 5 of such kind can be made of, for example, elastic material so that the restoring springs can be omitted.

Figure 9A:
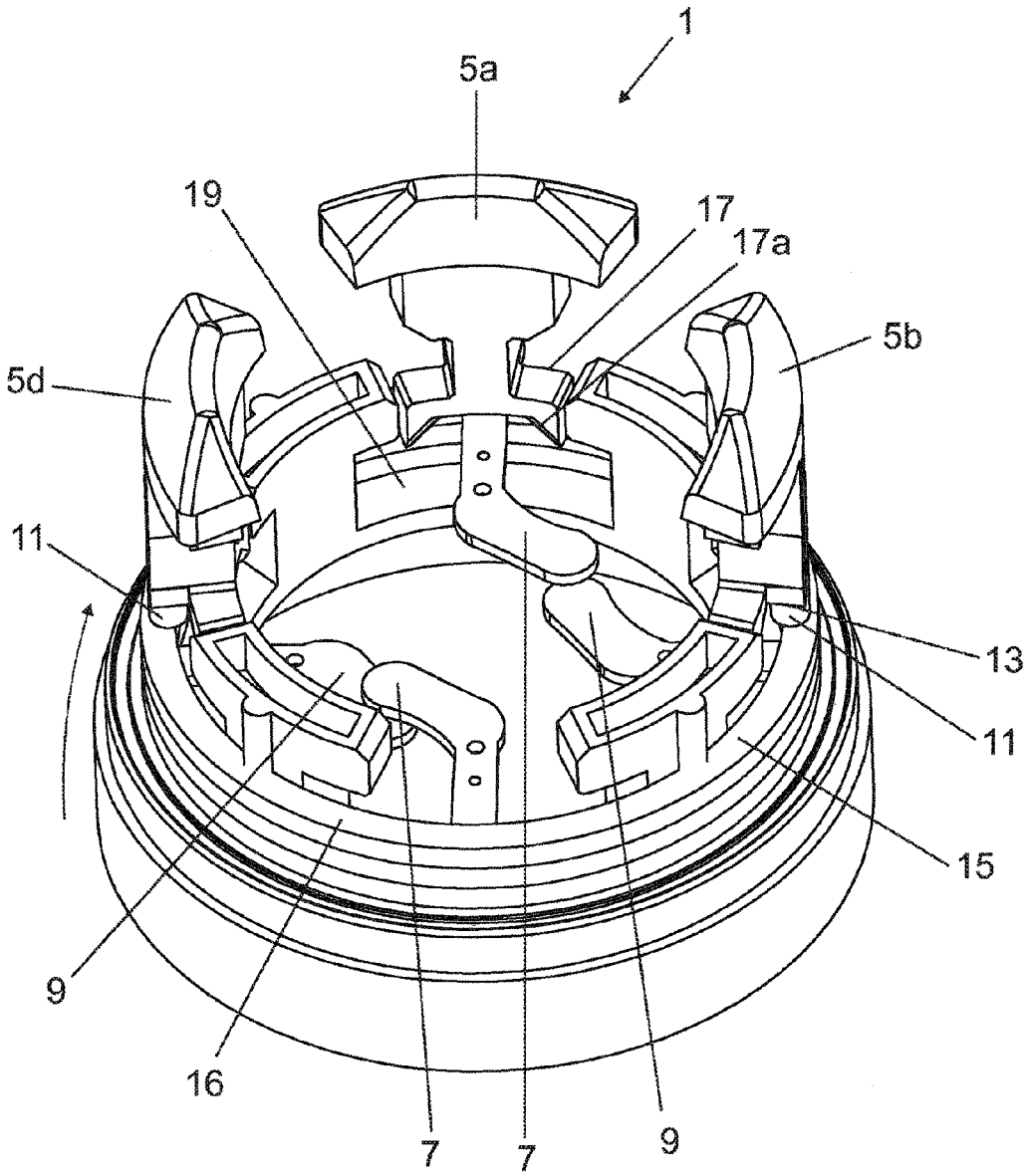
FIGS. 9*a*-9*c* show an end cap 1 according to another embodiment variant of the invention.
Figure 9B:
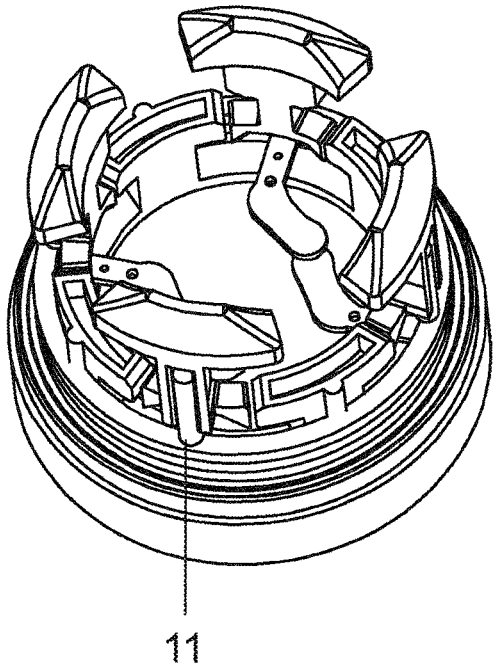
Figure 9C:
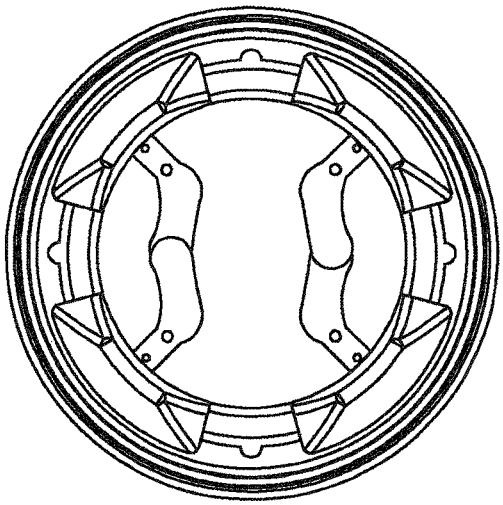

FIGS. 9*a*-9*c* show an end cap 1 according to another embodiment variant of the invention, with housing section 1*a* of end cap 1 being omitted in each case. That embodiment variant, compared with the previous embodiment variants, brings with it further aspects including a space saving in the base's interior due to the reduced number of sheet-metal strips as well as enhanced safety due to a rotary mechanism that is provided in addition to the pressing mechanism. In order to close the respective current path and electrically connect the associated pin to the lamp's internal electronics unit, according to that embodiment variant it is necessary first to push down each of the four sensing elements 5*a*-5*d* analogously to the first embodiment variant counter to its projection direction against the spring force of spring 11 (by means of contacting sensing elements 5*a*-5*d* with the holder) and then, when sensing elements 5*a*-5*d* have all been sufficiently pushed in, to twist sensing elements 5*a*-5*d* and sheet-metal strips 7, 9 relative to each other (with sensing elements 5*a*-5*d* in the pushed-in position).

According to that embodiment variant of the invention, four sheet-metal strips 7, 9 are secured by their radially outer end to a ring segment 1*b* of end cap 1, being for example embedded therein, and project at their radially inner, free end into the free interior of ring segment 1*b*. The two opposite sheet-metal strips 7 are mounted at a first height and form axially top sheet-metal strips 7 and the two opposite sheet-metal strips 9 are each mounted at a second height below the two top sheet-metal strips 7 and form axially bottom sheet-metal strips 9. Each bottom strip 9 is overlapped with an axial spacing by a top strip 7.

Sensing elements 5*a*-5*d* each have a shoe 17 on their underside. Ring segment 1*b* of end cap 1 has for each sensing element 5*a*-5*d* a slot 19 having a top and bottom segment, with the upwardly open top segment being narrowed relative to the bottom segment so that the bottom, widened segment extends beyond the top segment in the circumferential direction on both sides. Respective shoe 17 is located in the top segment of respective slot 19 (because sensing elements 5*a*-5*d* have been pushed up by springs 11) when sensing elements 5*a*-5*d* are in the non-loaded condition, which is to say when not (sufficiently) pushed. The top slot segment's length (in the circumferential direction) only slightly exceeds that of shoe 17 so that sensing elements 5*a*-5*d* will in their non-loaded condition be taken along by ring segment 1*b* when it is turned in the circumferential direction (see arrow in FIG. 9*a*) and so cannot be moved relative thereto (and consequently not relative to sheet-metal strips 7, 9 secured thereon). Shoe 17 will have been pushed into the bottom, widened segment of respective slot 19 and be located substantially centrally in the bottom slot segment if sensing elements 5*a*-5*d* have been pushed down far enough. However, bottom sheet-metal strips 9 will in that position not yet be contacted by respective top sheet-metal strip 7, meaning that shoe 17 of sensing element 5*a* or, as the case may be, 5*c* is in that position not yet pushing or not pushing sufficiently against top sheet-metal strip 7. With sensing elements 5*a*-5*d* in that pushed-down condition, ring segment 1*b* (including sheet-metal strips 7, 9) and the four pushed-down sensing elements 5*a*-5*d* mounted in the bottom slot segment, floating in the circumferential direction, can be turned relative to each other in the circumferential direction until the end face/longitudinal end of slot 19 is brought to a halt laterally against sensing element 5*a*-5*d* or, as the case may be, its shoe 17. Respective shoe 17 has on its underside an inclination 17*a* which pushes top sheet-metal strip 7 further and further down during the movement relative to sensing element 5*a* so that top sheet-metal strip 7 will be brought into axial electric contact with bottom sheet-metal strip 9. Ring segment 1*b* can be turned, for example, through the lamp's being turned.

According to a version of that embodiment variant, end cap 1 furthermore has a (for example annular) rotary segment which is linked in a torque-proof manner to the four sensors 5*a*-5*d* and can be rotationally moved relative to the lamp and the rest of end cap 1 (that means the end cap is embodied as being rotatable per se according to that version). The respective current path will be closed after the sensors have been pushed owing to contact with the holder and the rotary segment has been slightly turned in the holder for example through 15° relative to the lamp. The rotary segment is for example first turned back to its zero-point position when the lamp is removed by turning. Only then will the pins in the holder be turned. If both ends have an end cap according to that embodiment variant, then they can be designed, for example, such that the latching function can apply in the opposite direction. For example the rotary segment on end cap 1 can be embodied as being able to be blocked, with its being linked in its blocked position to end cap 1 in a torque-proof manner.

The four sensors 5*a*-5*d* will be in the zero-point position shown in FIG. 9*a* when the rotary segment is in the blocked position and when ring segment 1*b* is turned will not be moved relative thereto even if they are positioned in the bottom slot segment in a floating manner. The above-described relative rotary movement occurs as the result of loosening the rotary segment or, as the case may be, turning it to remove it from the block.

The exclusive function of sensing elements 5*b* and 5*d* is that of a turnstile. Unless all four sensing elements 5*a*-5*d* have been pushed with their shoe 17 into the bottom segment of associated slot 19, which is to say while the shoe of a sensing element 5*a*-5*d* remains in the top slot segment, a relative movement between the sensing elements and the end cap (and hence the relative movement between inclination 17 and sheet-metal strip 7) will be blocked so that no contacting will be possible between sheet-metal strips 7 and 9. It is for that reason not necessary to furnish shoes 17 of sensing elements 5*b* and 5*d* with inclinations 17.

For example top sheet-metal strip 7 of sensing element 5*a* can be wired to one pin, bottom sheet-metal strip 9 of sensing element 5*b* can be wired to the terminal segment of the lamp's electronics unit for said pin, top sheet-metal strip 7 of sensing element 5*c* can be wired to the other pin, and bottom sheet-metal strip 9 of sensing element 5*d* can be wired to the terminal segment of the lamp's electronics unit for said other pin.

Figure 10A:
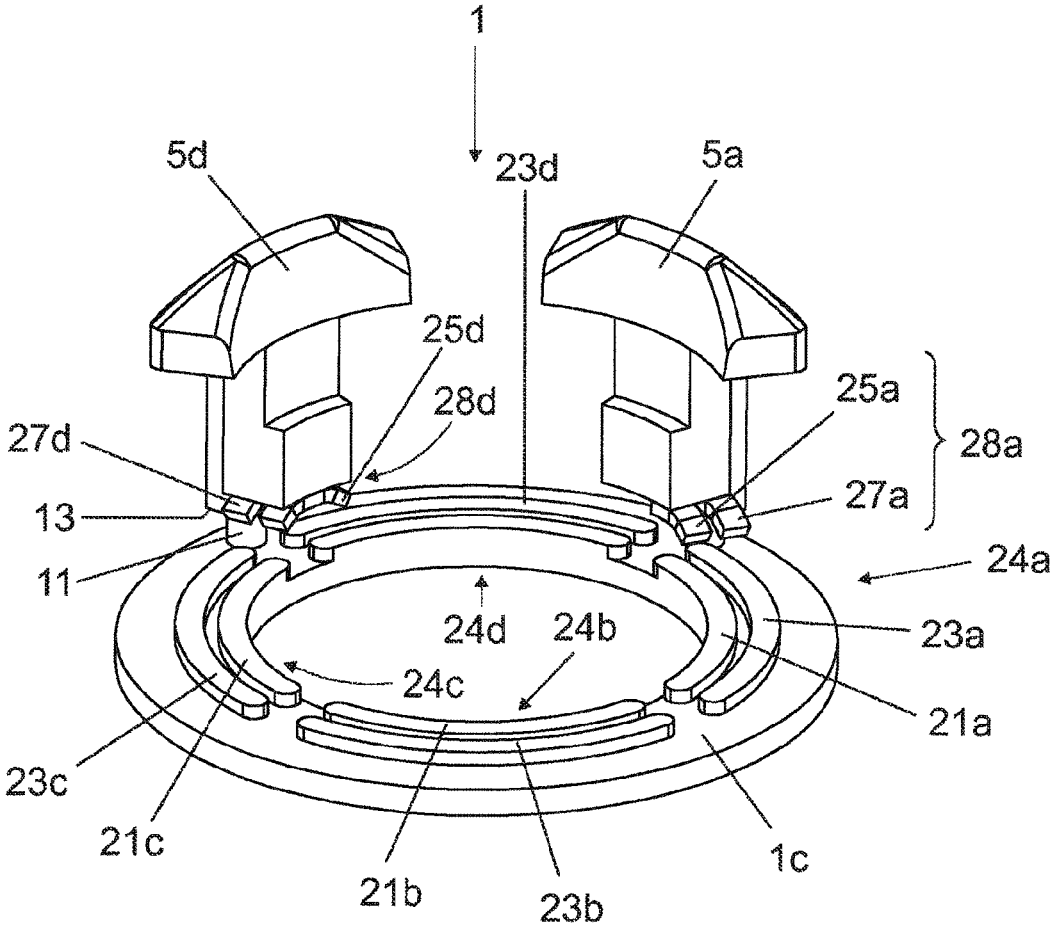
FIGS. 10*a*-10*c* show an end cap 1 according to another embodiment variant of the invention.
Figure 10B:
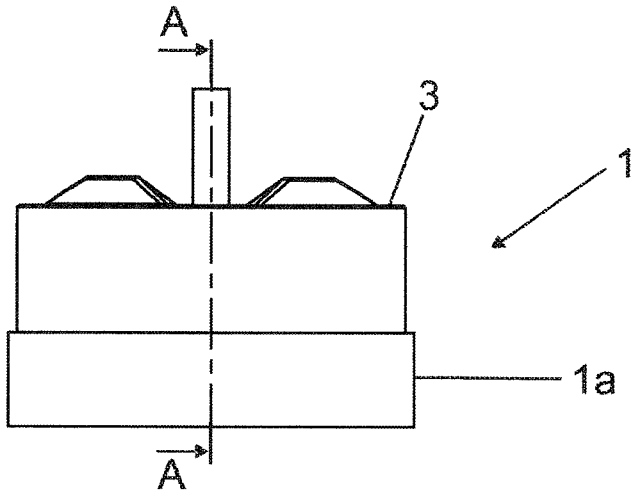
Figure 10C:
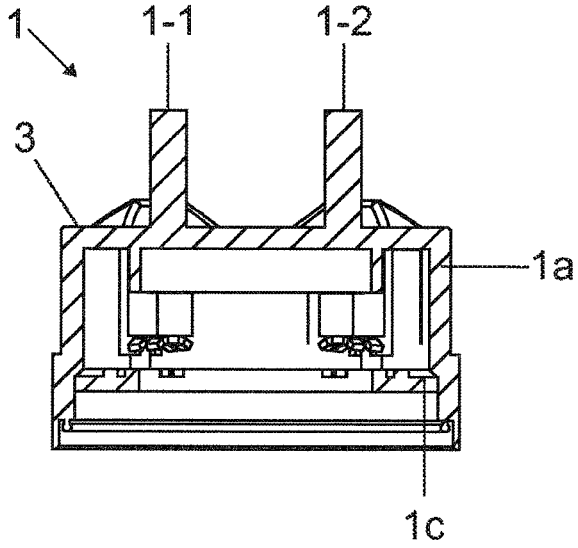

FIGS. 10*a* to 10*c* show an end cap 1 according to another embodiment variant of the invention. That embodiment variant, compared with the previous embodiment variants, brings with it further aspects including a space saving in the base's interior (for example a part of the electronic components, for instance an electronic ballast, can be accommodated here) as well as a simple and compact structure.

In FIG. 10*a*, the two sensing elements/sensors 5*b* and 5*c* and substantially cylindrical housing section 1*a* of end cap 1 have been omitted in the interests of clarity. The hatching in FIG. 10*c* is schematic and is intended solely to represent the cross-section, that is to say that the two pins 1-1, 1-2 and housing section 1*a* of end cap 1 have not been formed as a single piece or, as the case may be, are not made of the same material. The same applies to plate 1*c* and electrically conductive current-path sub-segments 21*a*-21*d* and 23*a*-23*d* applied thereupon.

End cap 1 has four sensing elements 5*a* to 5*d* projecting axially from front face 3 of end cap 1 and together forming a sensing unit. As described with reference to FIGS. 8*a*-8*d*, the invention is not, though, limited to exactly four sensing elements 5*a* to 5*d*, which means to say the number of sensing elements can be varied in that embodiment variant just as in the other embodiment variants. The four sensing elements 5*a* to 5*d* can each be pushed in axially downward in the lamp's longitudinal direction elastically against the spring force of spring 11. The respective sensor's travel is downwardly limited by a stop 13. All four sensing elements 5*a*-5*d* must have been pushed down simultaneously for the two pins 1-1, 1-2 to be galvanically coupled to the lamp's internal electronics unit. If at least one of sensing elements 5*a*-5*d* has not been pushed, then both first pin 1-1 and second pin 1-2 will be galvanically decoupled from the lamp's electronics unit.

Located inside end cap 1 or, as the case may be, housing section 1*a* is a plate 1*c* made of electrically insulating material. For example plate 1*c* can be annular in shape, for example circular. Arranged on the top side of plate 1*c* spaced apart one behind the other viewed in the circumferential direction of plate 1*c* are four radially inner electrically conductive sub-segments 21*a*-21*d*. Located further on the top side of plate 1*c* spaced apart one behind the other viewed in the circumferential direction are four radially outer electrically conductive sub-segments 23*a*-23*d*. Electrically conductive inner and outer sub-segments 21*a*-21*d* and 23*a*-23*d* can each have the shape of, for example, a ring arc, for instance that of a circle arc. In each case one radially inner sub-segment 21*a*-21*d* and one radially outer sub-segment 23*a*-23*d* form a pair 24*a*-24*d* of current-path sub-segments that are adjacent in the radial direction. Inner sub-segment 21*a*-21*d* and outer sub-segment 23*a*-23*d* of each pair 24*a*-24*d* extend substantially over the same angular range. The spaces formed between inner sub-segments 21*a*-21*d* and the spaces formed between outer sub-segments 23*a*-23*d* are situated substantially at the same height in the circumferential direction.

On a segment facing the plate's top side, for example on the underside, the four sensing elements 5*a* to 5*d* each have a radially inner electrically conductive sub-segment 25*a*-25*d* and a radially outer electrically conductive sub-segment 27*a*-27*d*. Each sensing element's two electrically conductive sub-segments form a pair 28*a*-28*d*. Pair 28*a*-28*d* consisting of radially inner and radially outer sub-segment 25*a*-25*d*, 27*a*-27*d* and secured to respective sensing element 5*a*-5*d* can be moved axially (meaning in the tube's longitudinal direction) together with the sensing element. A sensing element 5*a*-5*d* is in each case located between two successive ring-arc pairs 24*a*-24*d*. Sub-segments 25*b*-25*d*, 27*b*-27*d* attached to the three sensing elements 5*b*-5*d* in each case overlap the space formed between the two pairs 24*a*-24*d* bordering the sensing element so that the two bordering pairs will be mutually electrically linked via the sub-segments attached to the sensing element if the sensing element has been pushed down. Electrically conductive sub-segments 25*a* and 27*a* attached to sensing element 5*a* are conversely embodied such that the two pairs 24*a* and 24*b* will not be mutually electrically linked if the sensing element has been pushed down axially. That means to say that in the pushed-down condition sub-segments 25*a* and 27*a* will only contact pair 24*a*. The four inner and outer ring arcs will in each case have been connected in series if all the sensors have been pushed.

Inner and outer current-path sub-segments 25*a*-25*d* and 27*a*-27*d* secured to sensing elements 5*a* to 5*d* are each embodied as elastically bendable so that they can be pushed down further (for example by 1-4 mm) with contact still being maintained via the sensor after ring arcs 21*a*-21*d*, 23*a*-23*d* have initially been contacted. Current-path sub-segments 25*a*-25*d* and 27*a*-27*d* can for that purpose be embodied as, for example, strip-shaped having downwardly bent strip ends. The tolerances between the holder and lamp can be compensated thereby. The maximum sensor travel can be set via stop 13.

Together with radially inner electrically conductive sub-segments 25*a*-25*d* attached to sensing elements 5*a*-5*d*, radially inner electrically conductive sub-segments 21*a*-21*d* located on the plate's top side form a first current path for one of the two pins 1-1, 1-2. Together with radially outer electrically conductive sub-segments 27*a*-27*d* attached to sensing elements 5*a*-5*d*, radially outer electrically conductive sub-segments 23*a*-23*d* held by plate 1*a* analogously form a second current path for the other of the two pins 1-1, 1-2. The two closed current paths are each shaped like a slit ring and are arranged concentrically. The pins can be, for example, wired to the associated current-path sub-segment of pair 24*d* and current-path sub-segment 25*a*, 27*a* secured to sensing element 5*a* can be, for example, wired to the lamp's electronics unit.

Figure 11:
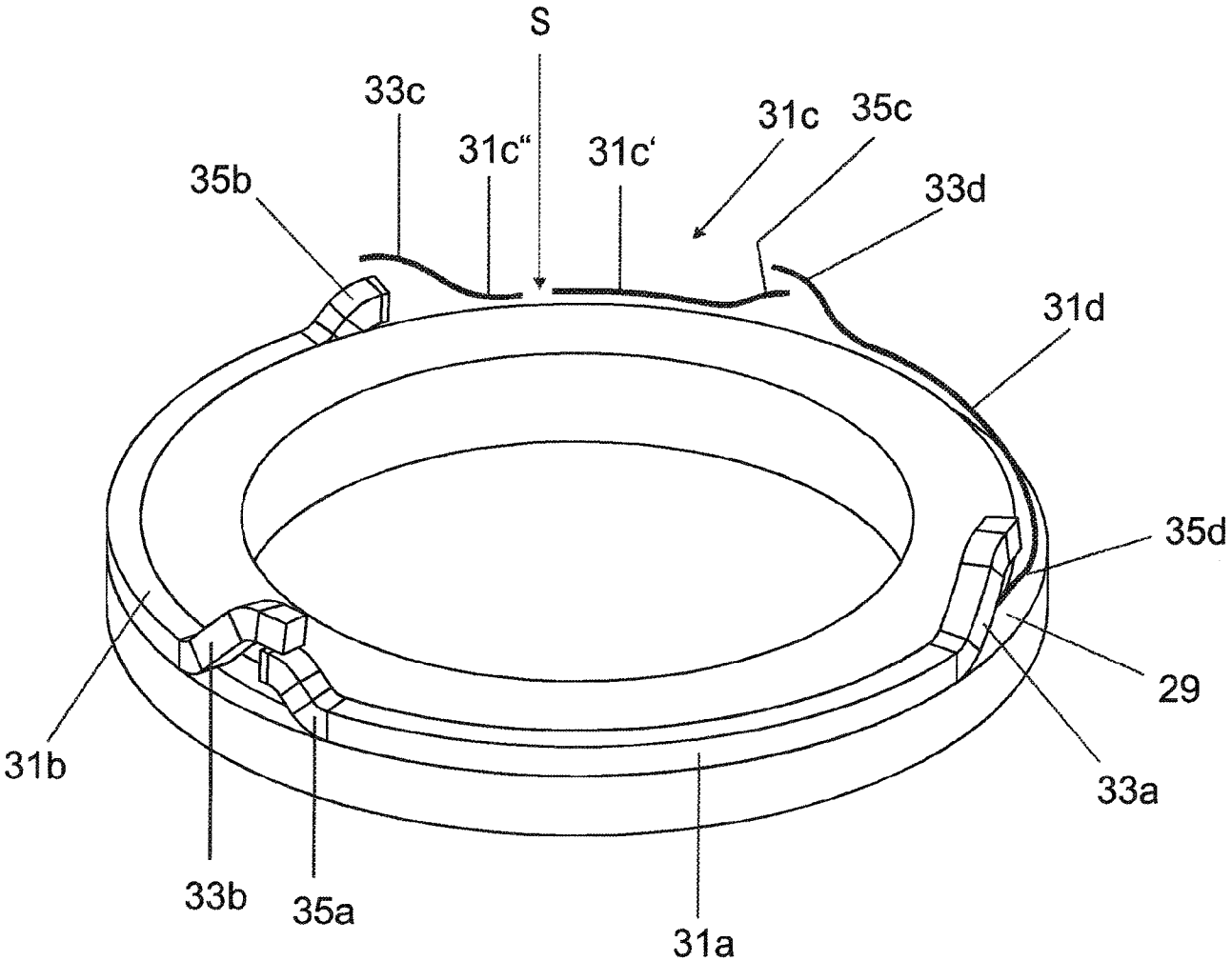
FIGS. 11*a*-11*b* show a plate 1*c* for using in an end cap according to another embodiment variant of the invention.

According to an alternative embodiment variant, current-path sub-segment pair 28*a* attached to sensor 5*a* can be embodied like the other pairs 28*b*-28*d*, with in each case an inner and outer ring segment being slit, resulting in the formation of two electrically insulated sub-segments (see the embodiment variant shown in FIG. 11).

FIG. 11*a* and FIG. 11*b* show another embodiment variant of the invention. Plate 1*c* can analogously to plate 1*c* of the embodiment variant shown in FIGS. 10*a*-10*c* be located inside end cap 1 or, as the case may be, housing section 1*a*. However, springs 11 and current-path sub-segments 25*a*-25*d*, 27*a*-27*d*, secured to sensors 5*a*-5*d*, shown in FIG. 10*a* can be omitted when plate 1*c* is used.

Arranged one behind the other on the top side of plate 1*c* in its circumferential direction are five radially outer electrically conductive sub-segments 31*a*, 31*b*, 31*c*, 31*d*, 31*c*" (sub-segment 33*d* has been shortened with the formation of a slit and terminal segment 31*c*" is arranged such that it will come to be situated under sub-segment 31*a*). Sub-segments 31*a*-31*d* can be embodied having the shape of a ring arc, for instance that of a circle arc. For example the sub-segments can be accommodated in a slot 29 in the plate's top side. The four sub-segments 31*a*-31*d* form a radially outer current path having multiple interruptions. Sub-segments 31*a*-31*d* transition axially into upwardly bent ring-arc segments 35*a*-35*d* to which sub-segments 33*a*-33*d* are in turn joined. Sub-segments 31*a*-31*d* and sub-segments 33*a*-33*d* overlap in each case with an axial spacing such that sub-segment 33*a* comes to be situated above sub-segment 31*b* and sub-segment 33*b* above sub-segment 31*c*, etc. Sub-segments 31*a*-31*d* can each be pushed elastically axially downward. Sub-segments 31*a*-31*d* will therefore be pushed axially downward by the sensors (against sub-segments 33*a*-33*d*) when sensors 5*a*-5*d* are in the engaged condition. Sensors 5*a*-5*d* will be pushed axially upward by axially raised ring-arc segments 35*a*-35*d* in the released condition or, as the case may be, when a departure is being made from the engaged condition so that restoring spring 11 can be omitted. The two sub-segments 33*a* and 31*b*, 31*c* and 33*b*, 33*c* and 31*d*, and 31*c*" and 31*a* will in each case be brought axially into electric contact when the sensor is pushed axially downward onto the overlapping region. The sensor can, after contact has been produced, be pushed axially further down against the spring force of sub-segment 33*a*-33*d*, as a result of which the tolerance between the holder and lamp will be compensated. The outer current path will be closed when all the sensors have been pushed down sufficiently. The closed current path is shaped like a slit ring. An exception here is sub-segment 31*a*, which is pushed not against shortened sub-segment 33*d* but against a terminal segment 31*c*". The pin assigned to the outer current path can, for example, be electrically connected to terminal segment 31*c*" and terminal segment 31*c*" can, for example, be electrically connected to the lamp's electronics unit.

Arranged furthermore on the top side of plate 1*c* one behind the other in the circumferential direction are five radially inner electrically conductive sub-segments (not shown) that form a radially inner current path. The electrically conductive inner sub-segments can, for example, be accommodated in an inner circumferential slot (not shown). The inner sub-segments are arranged in exactly the same way as outer sub-segments 31*a*-31*d*, which is to say mutually overlapping with an axial spacing and having upwardly bent ring-arc segments in the overlapping region. As in the third embodiment variant, in each case one radially inner sub-segment and one radially outer sub-segment form a pair of sub-segments that are adjacent in the radial direction and the inner sub-segment and outer sub-segment of each pair extend substantially over the same angular range. When sensors 5*a*-5*d* are pushed axially downward, they push simultaneously axially against in each case an inner and an outer overlapping region. Both current paths will be closed when all four sensors are pushed simultaneously. If at least one of the sensors has not been pushed, then both the radially inner and radially outer current path will be interrupted.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A rod-shaped retrofit lamp for replacing a fluorescent lamp, having an end face from which two pins project, with the two pins being connected to an internal electronics unit located in the lamp via a respective current path extending between the respective pin and the lamp's electronics unit, wherein the retrofit lamp furthermore has a mechanical sensing unit, and the respective current path has a plurality of electrically conductive sub-segments of which a first sub-segment is electrically connected to the associated pin and of which a second sub-segment is electrically connected to the lamp's electronics unit, wherein the mechanical sensing unit is capable of being elastically pushed in counter to its projection direction from a released condition into an engaged condition and interacting with the two current paths in such a way that the respective current path's first and second sub-segment will have been galvanically mutually coupled when the sensing unit is in the engaged condition so that the respective current path will have been closed and the associated pin thereby electrically connected to the internal electronics unit, whereas when the sensing unit is in the released condition the respective current path's first sub-segment will have been galvanically decoupled from the respective current path's second sub-segment so that the respective current path will have been interrupted and the associated pin thereby galvanically decoupled from the lamp's electronics unit, wherein the sensing unit for galvanically separating the two pins and hence for protecting users from shock hazards is taken from its released to its engaged condition in order to couple the lamp's internal electronics unit to the supply voltage only when the retrofit lamp has been completely fitted into a luminaire.

2. The lamp as claimed in claim 1, having a second end face which correspondingly to the one end face is furnished with two pins and a mechanical sensing unit.

3. The lamp as claimed in claim 1, wherein the respective sensing unit is located partially or completely in the circumferential region of the respective end face.

4. The lamp as claimed in claim 1, wherein the respective sensing unit pushes in its engaged condition against an elastically bendable electrically conductive sub-segment of the current path.

5. The lamp as claimed in claim 1, wherein the respective sensing unit has a plurality of sensing segments which project from the respective end face and can each be elastically pushed in counter to their projection direction from a released condition into an engaged condition, with the sensing segments interacting with the two current paths in such a way that the respective current path's first and second sub-segment will have been galvanically mutually coupled when all the sensing segments are simultaneously in the engaged condition, wherein the respective current path's first sub-segment has been galvanically decoupled from the respective current path's second sub-segment if at least one of the sensing segments is in the released condition.

6. The lamp as claimed in claim 5, wherein the respective sensing unit has at least three sensing segments that are distributed among three 120° front face sectors or at least or precisely four sensing segments that are distributed among four 90° front face sectors.

7. The lamp as claimed in claim 5, wherein the respective current path is formed by a plurality of electrically conductive sub-segments arranged one behind the other, wherein mutually adjacent sub-segments overlap in a spaced-apart manner when the sensing segments are in the released condition, and wherein the sub-segments in the overlapping regions have in the spacing direction been brought into electric contact by the pushed-down sensing segments when the sensing segments are in the engaged position.

8. The lamp as claimed in claim 7, wherein the respective current path's electrically conductive sub-segments are embodied as strips, wherein a plurality of pairs of strips each consist of a top electrically conductive strip and a bottom electrically conductive strip being arranged one behind the other, wherein the top strips of mutually adjacent pairs of strips overlap in a spaced-apart manner with a top current path being formed, and wherein the bottom strips of mutually adjacent pairs of strips overlap in a spaced-apart manner with a bottom current path being formed.

9. The lamp as claimed in claim 7, wherein the respective current path has a plurality of ring arcs arranged one behind the other, wherein mutually adjacent ring arcs of the respective current path overlap in a spaced-apart manner and each being bent upward in the overlapping region.

10. The lamp as claimed in claim 7, wherein the respective current path has a plurality of ring arcs that are arranged one behind the other in a spaced-apart manner and which will have been connected in series via electrically conductive sub-segments attached to the sensing segments when the sensing segments are in the engaged condition.

11. The lamp as claimed in claim 5, wherein the galvanic coupling of the respective current path's first and second electrically conductive sub-segment is achieved either directly through the sensing unit's being pushed in or by means of a relative rotational movement between the mechanical sensing unit and the electrically conductive sub-segments following the push-in action, wherein each of the sensing segments blocks the relative rotational movement in its released condition and enables it in its engaged condition so that the sensing segments first all have to be pushed down for the respective current path's first and second sub-segment to be galvanically coupled by means of the relative rotational movement.

12. The lamp as claimed in claim 1, wherein the galvanic coupling of the respective current path's first and second electrically conductive sub-segment is achieved either directly through the sensing unit's being pushed in or by means of a relative rotational movement between the mechanical sensing unit and the electrically conductive sub-segments following the push-in action.

13. An end cap for a lamp rod-shaped retrofit lamp for replacing a fluorescent lamp, having an end face from which two pins project, with the two pins being connected to an internal electronics unit located in the lamp via a respective current path extending between the respective pin and the lamp's electronics unit, wherein the retrofit lamp furthermore has a mechanical sensing unit, and the respective current path has a plurality of electrically conductive sub-segments of which a first sub-segment is electrically connected to the associated pin and of which a second sub-segment is electrically connected to the lamp's electronics unit, wherein the mechanical sensing unit is capable of being elastically pushed in counter to its projection direction from a released condition into an engaged condition and interacting with the two current paths in such a way that the respective current path's first and second sub-segment will have been galvanically mutually coupled when the sensing unit is in the engaged condition so that the respective current path will have been closed and the associated pin thereby electrically connected to the internal electronics unit, whereas when the sensing unit is in the released condition the respective current path's first sub-segment will have been galvanically decoupled from the respective current path's second sub-segment so that the respective current path will have been interrupted and the associated pin thereby galvanically decoupled from the lamp's electronics unit, wherein the sensing unit for galvanically separating the two pins and hence for protecting users from shock hazards is taken from its released to its engaged condition in order to couple the lamp's internal electronics unit to the supply voltage only when the retrofit lamp has been completely fitted into a luminaire, the end cap having an end face from which the two pins and the mechanical sensing unit project, and two current paths each consisting of a plurality of electrically conductive sub-segments for respectively connecting the pins to the lamp's electronics unit, with the mechanical sensing unit being capable of being elastically pushed in counter to its projection direction from a released condition into an engaged condition and interacting with the two current paths in such a way that the respective current path's first and second sub-segment will have been galvanically mutually coupled when the sensing unit is in the engaged condition whereas when the sensing unit is in the released condition the respective current path's first sub-segment will have been galvanically decoupled from the respective current path's second sub-segment.

* * * * *